United States Patent [19]

Yoshida et al.

[11] Patent Number: 5,064,807

[45] Date of Patent: Nov. 12, 1991

[54] COLORING AGENT CARRYING MEDIUM USED IN TWO-PHASE THERMAL RECORDING SYSTEM

[75] Inventors: Masato Yoshida; Niro Watanabe, both of Tokyo, Japan

[73] Assignee: Toppan Printing Co., Ltd., Tokyo, Japan

[21] Appl. No.: 570,763

[22] Filed: Aug. 22, 1990

[30] Foreign Application Priority Data

Aug. 23, 1989 [JP] Japan ..... 1-216576

[51] Int. Cl.[5] ..... B41M 5/035; B41M 5/26

[52] U.S. Cl. ..... 503/227; 8/471; 428/195; 428/236; 428/423.1; 428/447; 428/520; 428/913; 428/914

[58] Field of Search ..... 8/471; 428/195, 913, 428/914, 336, 423.1, 447, 520; 503/227

[56] References Cited

U.S. PATENT DOCUMENTS 4,503,095 3/1985 Seto et al. ..... 427/265
4,720,480 1/1988 Ito et al. ..... 503/227

FOREIGN PATENT DOCUMENTS 63-22693 1/1988 Japan .
1-148353 10/1989 Japan .

*Primary Examiner*—Bruce H. Hess
*Attorney, Agent, or Firm*—Armstrong, Nikaido, Marmelstein, Kubovcik & Murray

[57] ABSTRACT

A coloring agent carrying medium comprises a heat-resistant flexible substrate having a front surface, a plurality of transfer ink films formed on the front surface of the heat-resistant substrate at spacings and containing a pigment transferred to a recording medium upon application of heat, and a plurality of sublimation ink films formed on the front surface of the heat-resistant substrate between the transfer ink films and containing dyestuffs and at least one binder mainly composed of a crosslinked product of polyvinyl alcohol, and the binder allows the dyestuffs to penetrate into the recording medium without leaving from the heat-resistant flexible substrate.

22 Claims, 2 Drawing Sheets

COLORING AGENT CARRYING MEDIUM USED IN TWO-PHASE THERMAL RECORDING SYSTEM

FIELD OF THE INVENTION

This invention relates to thermal recording technology and, more particularly, to a coloring agent carrying medium used for reproducing color images on a recording medium.

DESCRIPTION OF THE RELATED ART

A typical example of a coloring agent carrying medium is disclosed in Japanese Patent Application laid-open (Kokai) No. 63-22693. The coloring agent carrying medium is shaped into a sheet and has a thin film of a coloring ink. The coloring ink contains a component dyestuff and supplies the dyestuff to a card-shaped recording medium of polyvinyl chloride upon being pressed thereonto with a thermal head The component dyestuff is considered to sublimate, and the sublimed dyestuff permeates the surface portion of the recording medium by the agency of heat applied from the thermal head But, other components of the coloring ink are left on the coloring agent carrying medium. Namely, the dyestuff is considered to be the subject of sublimation and directly changed to vapor phase. However, it is not sure whether the component dyestuff is directly charged to vapor or reaches the vapor via an intermediate liquid state. If the dyestuff is sublimed, the vaporous dyestuff permeates the surface portion of the recording medium. However, the liquid dyestuff may penetrate into the surface portion in case of the indirect transformation. Thus, the transforming mechanism is not clear, and, for this reason, the component dyestuff is referred to as a sublimation substance, a volatile substance or a heat fusible transfer substance. Without making any reference to the component dyestuff, those substances are considered to be identical with one another as long as they color recording mediums through permeance or penetration leaving behind other components.

Since the amount of the dyestuff permeating the surface of the recording medium is varied by changing the amount of heat applied from the thermal head to the coloring agent carrying medium, a complex image, such as a pictorial record, are reproducible in light and shade by changing the amount of the heat. If various dyestuffs which are different in color are allowed to selectively permeate, multi-color complex images are reproduced on the recording medium.

However, a problem is encountered in the prior art coloring agent carrying medium in that the gradations of the images to be reproduced are not so wide. This is because of the fact that the component dyestuff or dyestuffs are less sensitive to the heat being applied from the thermal head. Moreover, the dyestuff hardly reproduces black images, and, for this reason, the coloring agent carrying medium is not desirable for production or reproduction of character images.

Another example of the coloring agent carrying medium is known as a thermal transfer ribbon used in a thermal printer by way of example. The thermal transfer ribbon has a film of a transfer ink provided on a flexible film, and the transfer ink contains a pigment serving as a coloring agent. When the film of transfer ink is pressed onto a recording medium with a thermal head, the heat applied from the thermal head partially fuses the film of transfer ink, and the transfer ink thus to be fused is transferred onto the recording medium. The thermal head is assumed to produce a high temperature pattern representative of a letter of the alphabet, then the letter is reproduced on the recording medium through transfer of the ink. Thus, the transfer ink is fused upon exceeding a threshold temperature, and the fused transfer ink is entirely transferred to the recording medium. This means that the recording system using the film of transfer ink is of a two-step controlling sequence, and, for this reason, any gradations is hardly achieved by the film of transfer ink.

As to the recording operation on a card-shaped recording medium, various controlling sequences have been proposed, and a typical example is disclosed in Japanese Utility Model Application Serial No. 63-40789. According to the Japanese Utility Model Application laid open, a multiple color ribbon is installed in a thermal printer equipped with a thermal head, and each color segment periodically repeats along the longitudinal direction of the multiple color ribbon. The card-shaped recording medium is fixed in the thermal printer in facing relationship to the thermal head, and the multiple color ribbon extends in a space between the thermal head and the card-shaped recording medium. In the recording operation, the thermal head presses one of the color segments against the card-shaped recording medium, and a part of an image is produced in a color on the card-shaped recording medium. After the thermal head is released from the multiple color ribbon, the ribbon is slightly moved so that another color segment is placed between the thermal head and the card-shaped recording medium, and is then pressed against the card-shaped recording medium again for formation of another part of the image in another color. The thermal head and the card-shaped recording medium may be allowed to have relative motion while the multiple color ribbon is also moved. Thus, parts of the image or images are sequentially produced in different colors and finally built up into multiple color images.

The card-shaped recording medium of polyvinyl chloride has a wide variety of application such as, for example, a credit card or an identity card, and both an appearance and personal information are usually recorded thereon. The appearance is of the image with gradations, but the personal information is usually represented by letters. The image with gradations is reproduced by using the coloring ink of dyestuff, however, black letters, which are easy for reading, are formed through a two-step controlling sequence with a transfer ink as described hereinbefore. In other words, it is necessary for those applications to use not only the coloring agent carrying medium with the coloring ink of dyestuff, but also the different coloring agent carrying medium with the transfer ink of pigment. This makes the recording operation complex, because one of the color agent carrying mediums is replaced with the other medium. The card-shaped recording medium may be released from a first thermal printer equipped with a coloring agent carrying medium with a transfer ink of pigment and placed in a second thermal printer equipped with a coloring agent carrying medium with a coloring ink of dyestuff. However, in either case, the recording operation consumes a prolonged time period and, accordingly, increases the production cost of the credit card or the identity card.

SUMMARY OF THE INVENTION

To accomplish these objects, the present invention proposes to share a single heat-resistant substrate between a transfer ink section containing a pigment and a coloring ink section containing a dyestuff.

In accordance with the present invention, there is provided a coloring agent carrying medium comprising a heat-resistant substrate having a front surface, at least one transfer ink film formed on the front surface of the heat-resistant substrate and containing a color agent which is transferrable to a recording medium upon application of heat, and at least one sublimation ink film formed on the front surface of the heat-resistant substrate and containing at least one dyestuff of a sublimation substance, a volatile substance or a heat fusible transfer substance and at least one binder mainly composed of a crosslinked product of polyvinyl alcohol.

BRIEF DESCRIPTION OF THE DRAWINGS

The features and advantages of the coloring agent carrying medium according to the present invention will be more clearly understood from the following description taken in conjunction with the accompanying drawings in which.

DESCRIPTION OF THE PREFERRED EMBODIMENT

Structure and Component Elements

Figure 1:
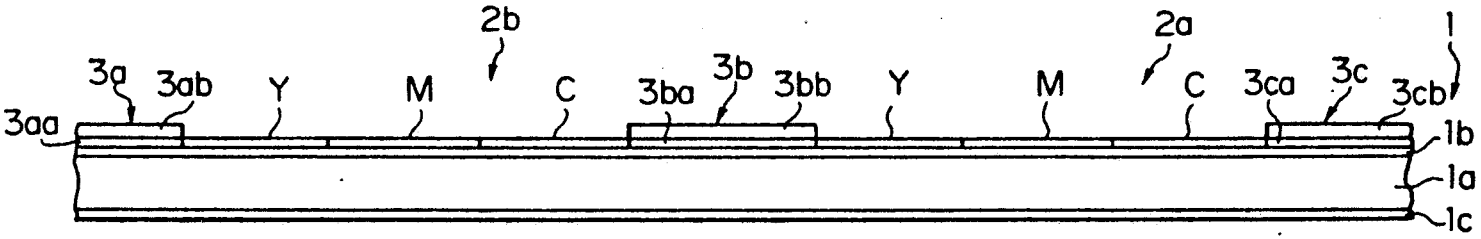
FIG. 1 is a side view showing a coloring agent carrying medium according to the present invention.
Figure 2:
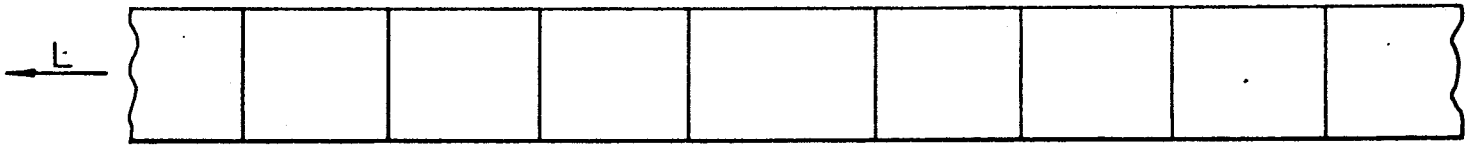
FIG. 2 is a plan view showing the color agent carrying medium shown in FIG. 1.

Referring first to FIG. 1 of the drawings, a coloring agent carrying medium embodying the present invention comprises a heat-resistant flexible substrate 1, a plurality of sublimation ink films including sublimation ink films 2*a* and 2*b*, and a plurality of transfer ink films including transfer ink films 3*a*, 3*b* and 3*c*. The transfer ink films 3*a*, 3*b* and 3*c* are provided on the heat-resistant flexible substrate 1 at spacings, and the sublimation ink films 2*a* and 2*b* are respectively inserted longitudinally between the transfer ink films 3*a*, 3*b* and 3*c*. Such an alternation is repeated along the longitudinal direction L of the heat-resistant flexible substrate 1 as will be seen from FIG. 2.

Turning back to FIG. 1, each of the sublimation ink films 2*a* and 2*b* has three sections Y, M, C assigned to the three primary colors, respectively, and the three primary colors are yellow, magenta and cyan (abbreviated as "Y", "M" and "C", respectively). Dyestuffs color the three sections Y, M and C yellow, magenta and cyan, and the dyestuffs are of a sublimation substance, a volatile substance or a heat fusible transfer substance. The dyestuffs should penetrate into a recording medium at 300 degrees to 400 degrees centigrade and are usually of a disperse dyestuff or an oil-soluble dyestuff. A thermal head incorporated in a thermal printer may supply heat to the sublimation ink films, and a driving pulse applied to the thermal head ranges from 5 volts to 50 volts for several seconds. Since the amount of heat to be applied changes the amount of the dyestuff penetrating into the recording medium, gradations are imparted to images to be reproduced thereon.

The dyestuffs are mixed with a binder, and the binder allows the dyestuffs to adhere to the heat-resistant flexible substrate 1. However, it is necessary for the binder per se not to adhere to a recording medium, of, for example, hard polyvinyl chloride, upon the application of heat. For this reason, a resin of crosslinked product of polyvinyl alcohol is desirable for the binder, and the molecular weight of the resin ranges from 10000 to 80000. Polyvinyl acetal and polyvinyl butyral are typical examples of the crosslinked product of polyvinyl alcohol. Another resin, such as ethyl cellulose, may be incorporated in the mixture of dyestuff and binder for promoting the penetration of dyestuff. However, it is desirable for each dyestuff to fall within the range between 30% and 70% by weight of the mixture so that thermal responsiveness of the sublimation ink films are improved.

The dyestuff for the yellow section Y may be selected from the commercial products of: Kayacet Yellow AG, and Kayakut Yellow TDN (manufactured by Nippon Kayaku Co,. Ltd.); PTY52, Dianix Yellow 5R-E, Dianix Yellow F3G-E, and Dianix Brilliant Yellow 5G-E (manufactured by Mitsubishi Chemical Industries Ltd.); Brust Yellow 8040 and DY 108 (manufactured by Arimoto Chemical Co,. Ltd.); Sumikaron Yellow EFG and Sumikaron Yellow E-4GL (manufactured by Sumitomo Chemical Co,. Ltd.); and FORON Brilliant Yellow SGGLPI (manufactured by Sand Corporation).

Dyestuffs available for the magenta section M are, by way of example, Kayacet Red 026, Kayacet Red 130, and Kayacet Red B (manufactured by Nippon Kayaku Co,. Ltd.); Oil Red DR-99 and Oil Red DK-99 (manufactured by Arimoto Chemical Co,. Ltd.); Diacelliton Pink B (manufactured by Mitsubishi Chemical Industries Ltd.); Sumikaron Red E-FBL (manufactured by Sumitomo Chemical Co,. Ltd.); Latyl Red B (manufactured by Du Pont); Sudan Red 7B (manufactured by BASF Corporation); and Resolin REd FB and Ceres REd 7B (manufactured by Bayer Corporation).

Followings are the dyestuffs available for the cyan section C: Kayalon Fast Blue FG, Kayacet Blue FR, Kayacet Blue 136, and Kayacet Blue 906 (manufactured by Nippon Kayaku Co,. Ltd.); Oil Blue 63 (manufactured by Arimoto Chemical Co,. Ltd.); HSB9 (manufactured by Mitsubishi Chemical Industries Ltd.); Disperse Blue #1 (manufactured by Sumitomo Chemical Co,. Ltd.); MS Blue 50 (manufactured by Mitsui Toatu Co,. Ltd.); Ceres Blue GN (manufactured by Bayer Corporation); and Duranol Brilliant Blue 2G (manufactured by ICI Corporation).

On the other hand, each of the transfer ink films 3, 3*b* and 3*c* is constituted by a separatory layer 3*aa*, 3*ba* or 3*ca* overlain by an ink layer 3*ab*, 3*bb* or 3*cb*. The separate layers 3*aa*, 3*ba* and 3*ca* are formed of a wax and aim at promotion of peeling off. The separatory layers 3*aa*, 3*ba*and 3*ca* require a low melt viscosity and should be weak in adhesion with the heat-resistant flexible substrate 1. The attractive candidates of such wax are paraffin wax, carnauba wax, montan wax, higher fatty acids, higher alcohols, higher fatty acid esters and higher fatty acid amides. Since it is preferable that the wax is melted and easily peels off upon application of heat, the wax has a melting point of about 60 degrees to 120 degrees in centigrade. The separate layers 3*aa*, 3*ba* and 3*ca* may contain other ingredient substances, but the wax-content should be equal to or greater than 70% by weight because of the easy separation. A resin component with a low softening point may be contained in the wax so as to regulate the adhesion to the heat-resistant flexible substrate 1. Such a resin component may be selected from the group consisting of an epoxy resin, a low molecular weight polyethylene, a copolymer of ethylene-acetic acid, a polyamide resin, a polyurethane resin, a polyester resin and a petroleum resin, and ranges from zero to 20% by weight.

Each of the ink layers 3*ab*, 3*bb* and 3*cb* adheres to the surface of the recording medium of hard polyvinyl chloride upon application of heat by means of the thermal head and, for this reason, contains a thermoplastic resin having a glass transition temperature of about 50 degrees to about 110 degrees in centigrade. The thermoplastic resin is surely conducive to enhancement of adhesion to the recording medium. When applying heat to each ink layer 3*ab*, 3*bb* or 3*cb*, the thermoplastic resin is of fluid like a rubber and adheres to the surface of the recording medium. However, if the glass transition temperature exceeds 110 degrees in centigrade, the ink layers 3*ab*, 3*bb* and 3*ca* are hardly transferred to the surface under normal printing conditions. Such an extremely high glass transition temperature is not desirable for the thermal head because of an excess load. On the other hand, if the glass transition temperature is less than 50 degrees in centigrade, images to be reproduced on the recording medium tend to be blurred due to scrubbing with the coloring agent carrying medium. The thermoplastic resin which meets the requirements is selected from the group consisting of saturated polyester resins; polyvinyl chloride resins such as polyvinyl chloride and vinyl chloride-vinyl acetate copolymers; acrylic resins such as polymethyl acrylate, poly-2-naphthyl acrylate, polymethyl methacrylate, polyethyl methacrylate, poly-t-buthyl methacrylate, polyphenyl methacrylate, methyl methacrylate-alkyl methacrylate copolymers (wherein the alkyl group has 2 to 6 carbon atoms), polymethyl chloroacrylate and acryl-styrene copolymers; and vinyl resins such as polystyrene, polydivinylbenzene, polyvinyltoluene and styrene-butadiene copolymers. It is desirable for any thermoplastic resin to have a glass transition temperature of ranging from about 50 degrees to about 110 degrees in centigrade.

A coloring agent or coloring agents are incorporated in the ink layers 3*ab*, 3*bb* and 3*cb*, and the coloring agent or agents are transferred to the recording medium together with the thermoplastic resin upon application of heat. The coloring agent or agents are, then, fixed on the surface of the recording medium by the agency of the thermoplastic resin. Any coloring agent may be available, but organic or inorganic pigments are desirable from the viewpoint of shade of color as well as weather resistance of images to be reproduced. The pigments include titanium oxide, calcium carbonate, Hansa Yellow, Oil Eme-2G, Oil Black, Pyrazolone Orange, Oil Red, red oxide, Anthraquinone Violet, Phthalocyanine Blue, aluminum powder, bronze powder, pearl essence, magnetic powders and carbon black.

If the ink layers 3*ab*, 3*bb* and 3*cb* contain a lubricant or lubricants, images to be reproduced are well resistive against a scratch. The lubricant may be selected from the group consisting of Teflon powder; polyethylene powder; natural wax such as animal wax, plant wax, mineral wax or petroleum wax, synthetic wax such as synthetic hydrocarbon wax or modified wax thereof, aliphatic alcohol and acid wax, aliphatic ester and glyceride wax, hydrogenated wax, synthetic ketone, amine and amide wax, chlorinated hydrocarbon wax or alpha-olefin wax; and zinc stearate.

In order to keep the transfer property excellent, the thermoplastic resin ranges from 40% to 80% by weight, the coloring agent is fallen within a range between 10% and 30% by weight, and the lubricant content is zero to 30% by weight. All of the weight percentages are determined with respect to the total weight of each ink layer.

The heat resistant flexible substrate 1 has a base film 1*a*, an anchor coating film 1*b* covering the front surface of the base film 1*a* and a back coating film 1*c* covering the back surface of the base film 1*a*. The base film 1*a* is so resistant to heat that any permanent deformation and softening hardly takes place even though heat is applied with the thermal head. For this reason, a polyester film is desirable for the base film 1*a*. Although the flexible substrate 1 is heat resistant, the flexible substrate 1 needs to propagate heat and promotes the peeling of the ink layers 3*ab*, 3*bb* and 3*cb*. This results in the base film 1*a* being as thin as 1 micron to 20 microns. In this instance, the flexible substrate 1 is about 1 centimeter to 20 centimeters wide and long enough to be wound on a suitable bobbin.

The anchor coating film 1*b* anchors the sublimation ink films 2*a* and 2*b* and the separatory layers 3*aa*, 3*ba* and 3*ca* to the base film 1*a*. Since the sublimation ink films 2*a* and 2*b* contain a binder mainly composed of, for example, polyvinyl acetal, the anchor coating film 1*b* is, by way of example, formed of a hardened product of polyurethane resin produced through reaction of a polyisocyanate with a polyol. The polyisocyanate is selected from the group consisting of 2, 4-tolylene diisocyanate, 2,6-tolylene diisocyanate, diphenylmethane diisocyanate, hexamethylene diisocyanate, naphthalene diisocyanate, m-xylylene diisocyanate and bitolylene diisocyanate. The polyol is selected from the group consisting of polyester polyols, polyester polyols and acrylic polyols. The polyurethane resins are marketed as urethane coatings or urethane adhesives. The polyisocyanates are commercially available under the trade names of NIPPOLLAN 3110, NIPPOLLAN 3113 and NIPPOLLAN 3115 manufactured by Nippon Polyurethane Industry Co., Ltd., and the polyols are further commercially available under the trade names of CORONATE EH also manufactured by Nippon Polyurethane Industry Co., Ltd.

The back coating film 1*c* aims at preventing the transfer ink films 3*a*, 3*b* and 3*c* and the sublimation ink films 2*a* and 2*b* from adhesion to the heat-resistant flexible substrate 1, which is referred to as "blocking phenomenon" at winding off. The back coating film 1*c* further prevents the heat-resistant flexible substrate 1 from adhesion to the thermal head while laterally sliding thereon, thereby promoting a smooth sliding motion. It is, therefore, desirable for the back coating film 1*c* to be formed of a silicone resin. The silicone resin is selected from the group consisting of modified silicone raisins prepared by condensing silicone intermediate condensates having alkoxy groups such as, for example, methoxy or ethoxy groups at their ends, with alkyl resins, epoxy resins, polyester resins and acrylic resins. The silicone resin is commercially available from Shin-Etsu Chemical Co., Ltd. under the name of KR218. The silicone resin may contain or be coated with silicone oil, and the silicone oil further improves the smooth sliding motion. The silicone oil may be of dimethylsilicone oil, methylphenylsilicone oil and polyether-modified silicone oil.

Fabrication Technology

The fabrication process starts with a preparation of the base film 1*a*, and the base film 1*a* is shaped into an elongated strip.

A resin paste for the anchor coating film 1*b* is prepared as described hereinbefore and, then, coated on the front surface of the base film 1*a* through a roll coating technique, a reverse coating technique, a gravure coating technique or the like. The resin paste thus coated is set and cured under ambient atmospheric at about 50 degrees in centigrade for about 48 hours. The anchor coating film 1*b* thus produced is desirably equal to or less than 5 microns thick because of the heat conduction. On the other hand, if the anchor coating film 1*b* is less than 0.1 micron, the anchor coating film 1*b* is too week to fixedly adhere to the base film 1*a*.

The silicone resin is also coated on the back surface of the base film 1*a* by using a gravure coating process, a roll coating process, a reverse coating process or the like, and the silicone resin is dried under ambient atmospheric at about 60 degrees in centigrade. The drying stage is completed while the silicone resin passes through an oven of about 10 meters long at 60 meters/-minute. If the back coating film 1*b* is of a double level structure, consisting of a silicone resin film and a silicone oil film, the aforesaid process is repeated twice for the silicone resin and the silicone oil. The back coating film 1*b* ranges from 0.1 micron thick to 5 microns thick.

Formation of the sublimation ink films 2*a* and 2*b* starts with preparation of printing ink by dissolving or dispersing each dyestuff and a binder into an appropriate solvent. Various well known solvents are available, and such a well known solvent may be of alcohol solvent, ketone solvent or aromatic solvent. The printing ink thus prepared is printed on the anchor coating film 1*b* through the gravure printing process, and the printing ink is, then, dried under ambient atmospheric at 60 degrees in centigrade. The drying stage is also completed while the ink passes through an oven of about 10 meters long at about 60 meter per minute. The thickness of each sublimation ink film 2*a* or 2*b* is within a range between about 0.5 micron and about 5 microns depending upon the shade of images being requested. If a single printing operation followed by a drying stage can not result in the target thickness, the process is repeated until the target thickness is achieved.

The separatory films 3*aa*, 3*ba* and 3*ca* are formed on the anchor coating film 1*b* by using the gravure printing technology followed by a drying stage under ambient atmospheric at 60 degrees in centigrade. The transfer ink films 3*ab*, 3*bb* and 3*cb* are further printed on the respective separatory films 3*aa*, 3*ba* and 3*ca* through the gravure printing technology and dried under ambient atmospheric at about 60 degrees in centigrade. The drying stages thus applied are carried out in an oven at a speed of 60 meter per minute. When the gravure printing stages and the drying stages are completed, the separatory films 3*aa*, 3*ba* and 3*ca* and the transfer ink films 3*ab*, 3*bb* and 3*cb* are 0.5 micron to 5 microns thick. The coloring agent carrying medium thus fabricated is hereinbelow referred to as "thermal transfer ribbon", and the thermal transfer ribbon is wound on a reed for use in a thermal printer system.

Practical Usage

Figure 3:
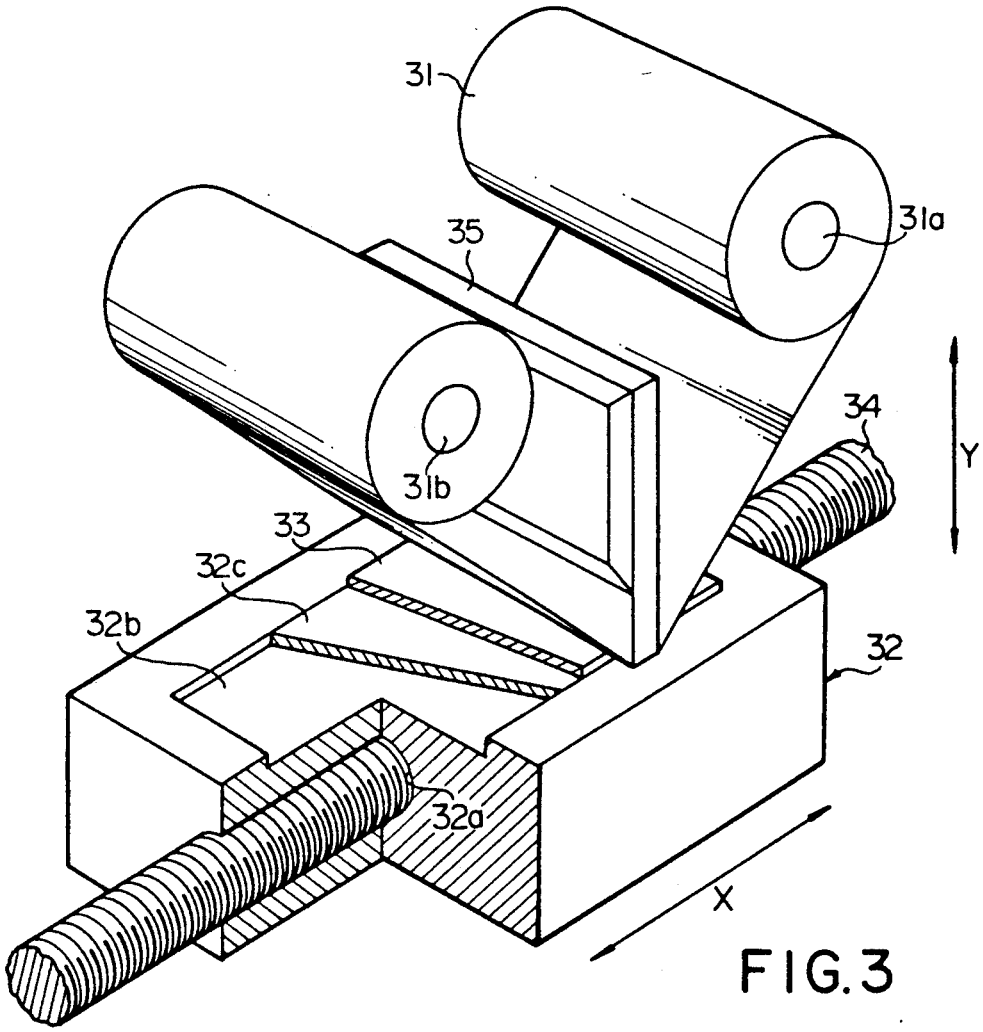
FIG. 3 a perspective view showing an essential part of a thermal printer system.

Turning to FIG. 3 of the drawings, a thermal transfer ribbon 31 according to the present invention is wound on reel members 31*a* and 31*b*. The reel members 31*a* and 31*b* are spaced apart from each other, and one of the reel members 31*a* or 31*b* is driven for rotation by a suitable driving mechanism (not shown). A movable block 32 is provided in association with a guide member (not shown), and a tapped bore 32*a* is formed in the movable block 32. In the top surface portion of the movable block 32 is formed a rectangular recess 32*b* where a resilient sheet 32*c* and a card-shaped recording medium 33 are snugly received. A threaded rod member is brought into meshing engagement with the tapped bore 32*a* and is driven for rotation by a motor unit (not shown), thereby causing the movable block 32 to travel in a direction X or vice versa. The card-shaped recording medium 33 is formed of a white polyvinyl chloride sheet member of 0.5 millimeter to 0.6 millimeter thick sandwiched between transparent hard polyvinyl chloride films of about 0.10 millimeter to 0.12 millimeter thick. The white polyvinyl chloride sheet adheres or is thermally bonded to the transparent hard polyvinyl chloride films. However, any card-shaped recording medium is available in so far as at least the surface thereof is formed of hard polyvinyl chloride. The resilient sheet 32*c* aims at a uniform pressure exerted on the card-shaped recording medium 33, and is, therefore, preferably of 40 degrees to 80 degrees in Shore hardness. An acrylonitrile-butadiene rubber is available for the resilient sheet 32*c*. In this instance, the resilient sheet 32*c* is 1 millimeter to 2 millimeter thick.

A thermal head 35 is reciprocally moved in directions Y between upper and lower positions, and the leading edge of the thermal head 35 is brought into contact with the thermal transfer ribbon 31 between the reel members 31*a* and 31*b*. When the thermal head 35 is in the upper position, the thermal transfer ribbon 31 is spaced apart from the card-shaped recording medium 33, However, the thermal transfer ribbon 31 is brought into contact with the card-shaped recording medium 33 in the lower position.

In operation, the thermal head 35 is lifted in the upper position, and the reels 31*a* and 31*b* are driven for rotation so that the yellow section Y is disposed beneath the leading edge of the thermal head 35. Then, the thermal head 35 is downwardly moved into the lower position, and the yellow section Y is pressed onto the card-shaped recording medium 33. A pulse signal is supplied to the thermal head, and the yellow dyestuff penetrates into the card-shaped recording medium 33. A part of an image is reproduced in yellow on the surface of the card-shaped recording medium 33. The thermal head 35 is lifted up again, and the threaded rod 34 causes the movable block to slightly move in the direction X. The thermal head 35 presses the yellow section Y again onto the chard-shaped recording medium 33, and another part of images is reproduced in yellow by virtue of heat. The thermal head 35 repeats the reciprocal motion while the card-shaped recording medium 32 slightly moves, thereby reproducing parts of images in yellow.

The movable block 32 returns to the initial position, and the magenta section M is moved beneath the leading edge of the thermal head 35. Parts of images are reproduced on the chard-shaped recording medium 33 in magenta through the reciprocal motion of the thermal head 35. When the parts of images are completed in magenta, the movable block 32 returns to the initial position again, and the thermal head 35 reproduces parts of images in cyan. Upon completion of the parts of images by using the sublimation ink films, the transfer ink film 3a, 3b or 3c is moved beneath the leading edge of the thermal head 35, and the residual parts of images are reproduced through the thermal transfer operation.

FIRST EXAMPLE

A 6 micron-thick, 10 centimeter-wide elongated polyester film was coated with an anchor coating film all over the front surface thereof by using the gravure coating technique. The anchor coating layer was formed by mixing 40 parts by weight of the polyester polyols (Coronate EH, Nippon Polyurethane Industry Co., Ltd.) with 100 parts by weight of diphenylmethane diisocyanate (Nippolan 3110, Nippon Polyurethane Industry Co., Ltd.) and by applying the mixture to the film immediately after the mixing. The thickness of the anchor coating layer was 1.0 micron after the drying stage.

After the anchor coating film was completely cured, sublimation ink films each having yellow, magenta and cyan sections and transfer ink films were formed thereon to a thickness of about 1.5 micron by using the gravure printing technique. The composition of ink for the sublimation ink films was as follows:

| | |
|---|---|
| Dyestuff: | 10 parts by weight |
| Polyvinyl butyral: | 9 parts by weight |
| Ethyl cellulose: | 1 part by weight |
| Isopropyl alcohol: | 30 parts by weight |
| Methyl ethyl ketone: | 9 parts by weight |

As to the dyestuffs, Kayacet Yellow AG (manufactured by Nippon Kayaku Co., Ltd.) was used for the yellow section, Kayacet Red 026 (manufactured by Nippon Kayaku Co., Ltd.) for the magenta section, and HSB9 (manufactured by Mitsubishi Chemical Industries Ltd.) for the cyan section.

Separatory layers and transfer ink layers were sequentially formed by using the gravure printing technique. The separatory layers were formed of carnauba wax coated to a thickness of 2.0 microns in dry. The composition of each transfer ink layer was as follows:

| | |
|---|---|
| Carbon black: | 4 parts by weight |
| Saturated polyester: (the glass transition temperature: 65 degrees in centigrade) | 15 parts by weight |
| Paraffin wax: | 1 part by weight |
| Toluene | 40 parts by weight |
| 2-Butanone: | 40 parts by weight |

The transfer ink layers were coated to a thickness of 2.0 microns in dry. The sublimation ink films as well as the transfer ink films were of the order of 7 centimeters in width.

Finally, a back coating film was formed all over the back surface of the film by using the gravure printing technique. In this instance, the back coating film is of the double level structure consisting of first and second back coating thin films, and the compositions thereof were described hereinbelow:

First Back Coating Film

| | |
|---|---|
| Silicon resin: (KS770A manufactured by Shin-Etsu Chemical Co., Ltd.) | 15 parts by weight |
| Curing agent: (PL-8 manufactured by Shin-Etsu Chemical Co., Ltd.) | 0.08 part by weight |
| Toluene: | 70 parts by weight |
| Methyl ethyl ketone: | 15 parts by weight |

Second Back Coating Film

| | |
|---|---|
| Methylphenylsilicone oil: (KF54 manufactured by Shin-Etsu Chemical Co., Ltd.) | 3 parts by weight |
| Toluene: | 57 parts by weight |
| Methyl ethyl ketone: | 40 parts by weight |

The first and second back coating films had thicknesses of 0.5 micron in dry and 0.2 micron in dry, respectively. The thermal transfer ribbon thus fabricated was taken up, and stored at 50 degrees in centigrade for 15 days. The reflection density of the back coating layer was measured. According to the measuring result, the measured density showed 0.05 at a portion in contact with the transfer ink film. This revealed that little blocking phenomenon took place.

A card-shaped recording medium was produced and comprises a 0.56 millimeter thick white polyvinyl chloride sheet sandwiched between 0.11 millimeter thick transparent hard polyvinyl chloride films with a polyurethane adhesive compound. This card was inserted into the rectangular recess 32b, and a portrait, his address and his name were printed on the front surface through the sequence described with reference to FIG. 3. The print started with the yellow section, then followed by the magenta section, then the cyan section, finally being carried out with the transfer ink film. The transfer ink films printed the letters representative of the address and the name as well as parts of the portrait in black such as his black hair. The letters and the portrait were completely reproduced, and no substantial difference in tint took place between the original images and the images to be reproduced on the card-shaped recording medium. No undesirable stick took place between the sublimation ink films and the chard-shaped recording medium throughout the printing operation.

SECOND EXAMPLE

Another thermal transfer ribbon was fabricated in a similar manner to the first example except for the transfer ink films. The composition of the separatory layer was:

| | |
|---|---|
| Rice wax: | 11 parts by weight |
| Polyester wax: | 6 parts by weight |
| Toluene: | 83 parts by weight |

The composition of the transfer ink layer was indicated as:

| | |
|---|---|
| Carbon black: | 4 parts by weight |
| Methyl methacrylate: (the glass transition temperature: 105 degrees in centigrade) | 10 parts by weight |
| Vinyl acetate copolymer: (the glass transition temperature: 65 degrees in centigrade) | 4 parts by weight |
| Teflon powder: | 2 parts by weight |
| Toluene: | 55 parts by weight |

-continued

| | |
|---|---|
| 2-Butanone: | 25 parts by weight |

After the thermal transfer ribbon was completed, the thermal transfer ribbon was stored at 50 degrees in centigrade for 15 days, and the reflection density of the back coating film measured 0.02 at a portion in contact with the transfer ink film. This revealed that little blocking phenomenon took place. The sublimation ink films were never stuck on the card-shaped recording medium.

THIRD EXAMPLE

Still another thermal transfer ribbon was fabricated in a similar manner to the first example, but no anchor coating layer was provided therein. The thermal transfer ribbon was stored at 50 degrees in centigrade for 15 days, and images were reproduced through the printing operation. The tint was matched with the original images, but the sublimation ink films were slightly stuck at high density portion of the images on the card-shaped recording medium. This resulted in that the luster of the polyvinyl chloride was lost.

FOURTH EXAMPLE

The second back coating film was not incorporated in till another thermal transfer ribbon, but the other structure is similar to the first example. The thermal transfer ribbon was stored at 50 degrees in centigrade for 15 days, and the reflection density of the back coating film measured 0.3 which revealed that a little blocking phenomenon took place. The printing operation was carried out as similar to the first example; however, the ribbon made noises while sliding, and the noises were considered to be resulted from stick on the card-shaped recording medium. However, the tint of images to be reproduced was excellent, and the images were clear as expected.

As will be understood from the foregoing description, the coloring agent carrying medium according to the present invention is advantageous in that multicolor images are clearly reproduced without changing the ribbon. In detail, the images to be reproduced have the gradations because the sublimation ink films are used therefore. Moreover, letters are printed in black by using the transfer ink films without any replacement of ribbon. Thus, the coloring agent carrying medium according to the present invention is suitable for reproduction of the multi-color images including a portrait and letters by way of example.

Since the sublimation ink films contain the binder mainly composed of a crosslinked product of polyvinyl alcohol, only the dyestuff penetrates into the recording medium. This is another advantage of the present invention. Moreover, the back coating film allows smooth winding off, and this prevents a thermal printer system from troubles.

Although particular embodiment of the present invention have been shown and described, it will be obvious to those skilled in the art that various changes and modifications may be made without departing from the spirit and scope of the present invention. First, the coloring agent carrying medium according to the present invention is not always shaped into a ribbon. Another coloring agent carrying medium may be formed into a wide sheet.

What is claimed is:

1. A coloring agent carrying medium comprising a heat resistant substrate having a front surface, at least one transfer ink film formed on the front surface of said heat-resistant substrate and containing a color agent transferable to a recording medium in the presence of heat, and at least one sublimation ink film formed on the front surface of said heat-resistant substrate in the vicinity of said transfer ink film and containing at least one dyestuff and at least one binder mainly composed of a crosslinked polyvinyl alcohol.

2. A coloring agent carrying medium as set forth in claim 1, in which said crosslinked polyvinyl alcohol is selected from the group consisting of polyvinyl acetal and polyvinyl butyral.

3. A coloring agent carrying medium as set forth in claim 2, in which said crosslinked polyvinyl alcohol has the molecular weight ranging from about 10,000 to 80,000.

4. A coloring agent carrying medium as set forth in claim 1, in which each of said transfer ink films comprises a separatory layer provided on said heat-resistant substrate and an ink layer containing said coloring agent provided on said separatory layer.

5. A coloring agent carrying medium as set forth in claim 4, in which said coloring agent is selected from the group consisting of organic pigments and inorganic pigments.

6. A coloring agent carrying medium as set forth in claim 5, in which said ink layer further contains a thermoplastic resin which enhances the adhesion thereof to said recording medium, and in which said thermoplastic resin has a glass transition temperature of about 50 degrees to about 110 degrees in centigrade.

7. A coloring agent carrying medium as set forth in claim 6, wherein said thermoplastic resin is selected from the group consisting of saturated polyester resins; polyvinyl chloride; vinyl chloride-vinyl acetate copolymers; polymethyl acrylate; poly-2-naphthyl acrylate; polymethyl methacrylate; polyethyl methacrylate; poly-t-butyl methacrylate; polyphenyl methacrylate; methyl methacrylate-alkyl methacrylate copolymers (wherein the alkyl group has 2 to 6 carbon atoms; polymethyl chloroacrylate; acrylicstyrene copolymers; polystyrene; polydivinylbenzene; polyvinyltoluene; and styrene-butadiene copolymers.

8. A coloring agent carrying medium as set forth in claim 5, in which said ink layer further contains a lubricant.

9. A coloring agent carrying medium as set forth in claim 8, in which said lubricant is selected from the group consisting of a Teflon powder, a polyethylene powder, a natural wax, a synthetic wax and zinc stearate.

10. A coloring agent carrying medium as set forth in claim 4, in which said separatory layer is formed of a wax.

11. A coloring agent carrying medium as set forth in claim 10, in which said wax is selected from the group consisting of paraffin wax, carnauba wax, montan wax, higher fatty acids, higher alcohols, higher fatty acid esters and higher fatty acid amides.

12. A coloring agent carrying medium comprising a) a heat-resistant substrate having a front surface, b) a plurality of transfer ink films formed on the front surface of said heat-resistant substrate at spacings and containing a coloring agent transferrable to a recording medium in the presence of heat, and c) a plurality of sublimation ink films formed on the front surface of said heat-resistant substrate between said transfer ink films and containing at least one dyestuff and at least one binder mainly composed of a crosslinked polyvinyl alcohol.

13. A coloring agent carrying medium as set forth in claim 12, in which each of said sublimation ink films has a plurality of sections respectively of different colors.

14. A coloring agent carrying medium as set forth in claim 13, in which said plurality of sections are respectively of the primary three colors.

15. A coloring agent carrying medium as set forth in claim 12, in which said heat-resistant substrate comprises a base film, an anchor coating film on one surface of the base film and a back coating film on the opposite surface of the base film, said anchor coating film providing said front surface of said heat-resistant substrate.

16. A coloring agent carrying medium as set forth in claim 15, in which said base film is formed of polyester.

17. A coloring agent carrying medium as set forth in claim 16, in which said base film ranges from 1 micron to 20 microns.

18. A coloring agent carrying medium as set forth in claim 15, in which said anchor coating film is formed of a polyurethane resin.

19. A coloring agent carrying medium as set forth in claim 18, in which said anchor coating film ranges from 0.1 micron to 5 micron.

20. A coloring agent carrying medium as set forth in claim 15, in which said back coating film is formed of a silicone resin.

21. A coloring agent carrying medium as set forth in claim 20, in which said silicon resin is coated with a silicon oil.

22. A coloring agent carrying medium comprising a heat-resistant substrate having a front surface, at least one transfer ink film, formed on the front surface of said heat-resistant substrate, and containing a color agent transferable to a recording medium in the presence of heat, and at least one sublimation ink film formed on the front surface of said heat-resistant substrate in the vicinity of said transfer ink film and containing at least one dyestuff and at least one binder mainly composed of a crosslinked polyvinyl alcohol, said heat-resistant substrate comprising a base film and an anchor coating film on one surface of said base film, said anchor coating film allowing said transfer ink film to easily separate therefrom, said anchor coating film further allowing only said dyestuff to be conveyed from said sublimation ink film through sublimation, said anchor coating film providing said front surface of said heat-resistant substrate.

* * * * *